US007048150B2

(12) United States Patent
Barnett et al.

(10) Patent No.: US 7,048,150 B2
(45) Date of Patent: May 23, 2006

(54) FLUID CONTAINER

(75) Inventors: Burton Barnett, Rossmoor, CA (US); Kenneth I. Brody, Pacific Palisades, CA (US)

(73) Assignee: B&B Company, a California Partnership, Pacific Palisades, CA (US)

( * ) Notice: Subject to any disclaimer, the term of this patent is extended or adjusted under 35 U.S.C. 154(b) by 506 days.

(21) Appl. No.: 10/321,862

(22) Filed: Dec. 17, 2002

(65) Prior Publication Data

US 2004/0112926 A1 Jun. 17, 2004

(51) Int. Cl.
*B67D 5/60* (2006.01)

(52) U.S. Cl. ..... 222/143; 222/530

(58) Field of Classification Search ..... 222/529, 222/530, 143; 215/10; 206/506, 507
See application file for complete search history.

(56) References Cited

U.S. PATENT DOCUMENTS 2,852,216 A 9/1958 Peters
4,073,413 A 2/1978 Tabler et al.
4,095,728 A 6/1978 Chlystun
4,236,655 A * 12/1980 Humphries ..... 222/530
4,351,454 A * 9/1982 Maynard, Jr. ..... 222/143
4,708,253 A * 11/1987 Mednis ..... 222/143
5,078,286 A * 1/1992 Hashimoto ..... 222/529
5,119,972 A * 6/1992 Reed et al. ..... 222/143
5,133,481 A 7/1992 Mayfield
5,400,928 A 3/1995 Resnick
5,722,570 A 3/1998 Sultzer, III
5,934,522 A 8/1999 Canela et al.
6,029,858 A * 2/2000 Srokose et al. ..... 222/143
6,050,455 A * 4/2000 Soehnlen et al. ..... 222/143
6,112,949 A 9/2000 Rhodes et al.

* cited by examiner

*Primary Examiner*—Philippe Derakshani
(74) *Attorney, Agent, or Firm*—John S. Christopher

(57) ABSTRACT

A fluid container for use in accessing an obstructed fill port of a machine for inserting fluids therein includes a housing for containing a fluid, the housing having a top surface with an opening formed therein. A collapsible tube is aligned with the opening and affixed to the housing for providing a fluid exit path, the tube being manually extended and retracted. A channel is formed on the top surface of the housing for receiving the collapsible tube when the tube is in a retracted lateral position. An alternative embodiment of the fluid container exhibits a molded pocket formed beneath the bottom surface of a first housing for receiving a collapsible tube of a second housing when the collapsible tube of the second housing is in a retracted lateral position. Both the channel and the molded pocket facilitate vertical stacking of the containers.

19 Claims, 3 Drawing Sheets

FLUID CONTAINER

BACKGROUND OF THE INVENTION

1. Technical Field

The present invention relates to fluid containers. More specifically, the present invention relates to methods and apparatus for a fluid container having a permanently attached collapsible tube exhibiting a bellows-like construction in combination with an external molded channel for nesting the collapsible tube in a retracted lateral position, the container for use in inserting fluids into a fill port that is obstructed or otherwise not conveniently accessible.

2. Background Art

Fluid containers have long been known and used for containing fluids for many different uses and applications. One common application for these containers is for containing replacement fluids for engines such as, for example, oil, transmission fluid, brake fluid and the like. Many of these fluid containers are designed and configured for pouring the replacement fluid into the appropriate fluid reservoir with a minimum of spillage of the fluid. An example of this design is exhibited by a plastic container used for containing replacement engine oil. The main body of this fluid container is characterized by a tapering down of the main body into a narrow vertical neck where the neck terminates in a threaded spout for receiving a mating threaded cap.

In this design, the main body of the fluid container is typically grasped with the hand and the narrow neck and spout are directed to the opening of the fluid reservoir. This approach is effective when the fluid reservoir fill port is unobstructed so that the terminal end or lip of the container spout can be positioned in close proximity to the fill port. A problem arises when the fill port of the fluid reservoir is obstructed, i.e., for example, when the fill port is surrounded by other engine components and accessories, tubing, electrical wiring and the like. In particular, these other engine components, accessories, tubes, wires and the like may be positioned at the same level or above the level of the fluid reservoir fill port.

Under these obstructed conditions, the terminal end or lip of the container spout must necessarily be positioned above the engine fill port when the threaded cap of the fluid container is removed. Thus, the obstruction results in the terminal end or lip of the container spout not being directly at the fill port but being elevated above the fill port. Consequently, pouring of the fluid without spillage is complicated by (a) the distance from, i.e., above, the fill port, and (b) the mechanics of the liquid being poured, particularly high viscosity fluids. Fluid containers typically have only a single opening or outlet. Thus, when the fluid is poured out, the void caused by the displaced fluid must be replaced by air. Thus, when the fluid is exiting the container spout, air is simultaneously entering the container spout. Consequently, the exiting fluid pulses as the air enters the fluid container to displace the exiting fluid volume. As a result, the flow path of the fluid becomes unpredictable and spillage is more likely to occur.

Another problem exists with conventional fluid containers such as those employing the container design characterized by the narrow neck and spout extending above the main body thereof. Because of their design, these conventional fluid containers cannot be conveniently or easily stacked on store shelves or in shipping cartons. Consequently, available shelf space is wasted since a second fluid container of this design cannot conveniently be stacked above a first fluid container of the same type.

Thus, there is a need in the art for a fluid container comprised of plastic or other suitable material for use in containing a variety of fluids or other pourable materials. The fluid container includes a top opening having a permanently attached collapsible tube with a bellows-like flexible construction which can be manually extended or retracted, in combination with either (1) an external top molded channel for receiving the collapsible tube when in a retracted lateral position, or (2) a molded pocket formed within the bottom surface of a housing of a first fluid container for receiving a collapsible tube when in a retracted lateral position and molded to the top surface of a housing of a second fluid container positioned beneath the first fluid container, wherein both designs facilitate the vertical stacking of the housings of the fluid containers.

DISCLOSURE OF THE INVENTION

Briefly, and in general terms, the present invention provides a new and improved fluid container having a permanently attached collapsible tube exhibiting a bellows-like or accordion-like construction in combination with an external molded channel for nesting the collapsible tube in a retracted lateral position. This construction facilitates vertical stacking of a plurality of the fluid containers for storage and display purposes. The fluid container is typically used by persons for adding a variety of initial or replacement fluids such as, for example, water, oil, transmission fluid or other pourable materials to, for example, an engine or other container having an obstructed fill port or which is otherwise not conveniently accessible.

In a preferred embodiment, the fluid container can be comprised of, for example, a rectangular plastic housing having a top surface, bottom surface, and four vertical sides including front and rear sides, and left and right sides. The top surface includes a single opening formed therein. A collapsible tube is aligned with the single opening in the top surface and is permanently affixed to the housing, for example, as by molding. The collapsible tube serves as an exit path for the fluid stored within the inventive fluid container. Since the collapsible tube exhibits a bellows-like or accordion-like construction, the tube can be manually extended and retracted. Additionally, the distal end of the collapsible tube is threaded for receiving a threaded cap.

In the preferred embodiment, the fluid container further includes a channel formed on the top surface of the housing thereof. The channel is generally U-shaped and functions to receive the collapsible tube when the collapsible tube is in the retracted lateral position. The construction of the channel includes a pair of parallel vertical sides and an upright support where the height of the parallel vertical sides and the upright support exceeds that of the collapsible tube. Thus, this design facilitates vertical stacking of a plurality of the inventive fluid containers for storage and display when the collapsible tube is nested within the U-shaped channel.

The present invention is generally directed to a fluid container having a permanently attached, flexible, bellows-like collapsible tube for use in accessing an obstructed or inaccessible fill port of, for example, an engine or other container for inserting initial or replacement fluids therein, in combination with an external molded channel for nesting the collapsible tube when in a retracted lateral position. In its most fundamental embodiment, the fluid container includes a housing for containing a fluid, the housing having a top surface with an opening formed therein. A collapsible tube is aligned with the opening and is affixed to the housing for providing an exit path for the fluid. The collapsible tube can be manually extended and retracted. Finally, a channel is formed on the top surface of the housing for receiving the collapsible tube when the collapsible tube is in a retracted lateral position. The channel serves to facilitate vertical stacking of a plurality of the housings of the fluid containers.

An alternative embodiment of the fluid container includes a first housing for containing a fluid and having a top surface and a bottom surface with an opening formed within the top surface. A collapsible tube is aligned with the opening in the top surface and is affixed to the first housing for providing an exit path for the fluid where the collapsible tube can be manually extended and retracted. A molded pocket is formed beneath the bottom surface of the first housing for receiving a collapsible tube of a second housing when the collapsible tube of the second housing is in a retracted lateral position. The molded pocket of the first housing facilitates vertical stacking of the first housing and the second housing.

These and other objects and advantages of the present invention will become apparent from the following more detailed description, taken in conjunction with the accompanying drawings which illustrate the invention, by way of example.

DETAILED DESCRIPTION OF THE INVENTION

The present invention is a fluid container 100 having a permanently attached collapsible tube 102 exhibiting a bellows-like or accordion-like construction in combination with an external molded channel 104 for nesting the collapsible tube 102 in a retracted lateral position. This construction facilitates vertical stacking of a plurality of the fluid containers 100 for storage, shipping and display purposes. The fluid container 100 of the preferred embodiment is shown in FIGS. 1–6 and is typically employed by persons for use in inserting a variety of initial or replacement fluids into a fill port (not shown) of, for example, an engine or other container where the fill port is obstructed or otherwise not conveniently accessible.

Figure 1:
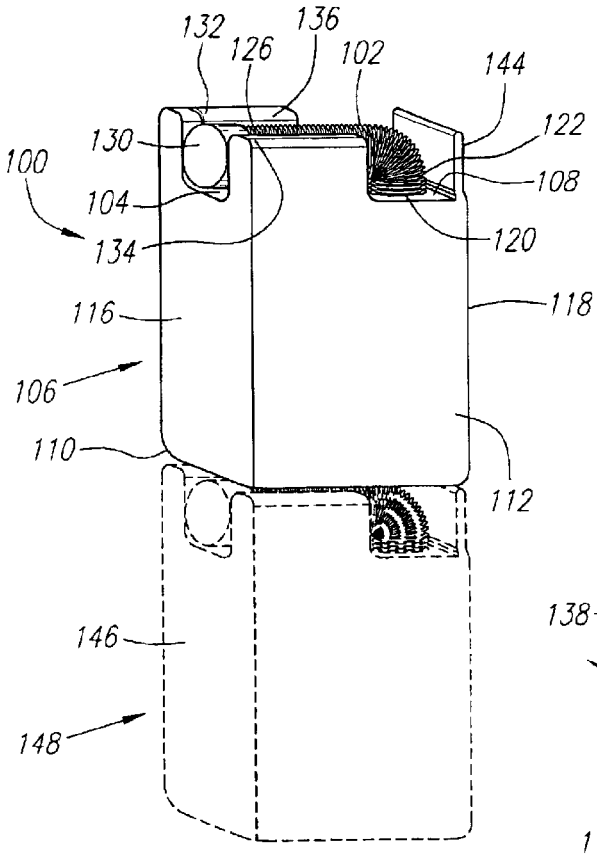
FIG. 1 is a perspective view of a fluid container of the present invention having a permanently attached collapsible tube shown in the retracted lateral position within an external channel molded within the top of the fluid container, the fluid container shown stacked above a second fluid container shown in phantom.
Figure 2:
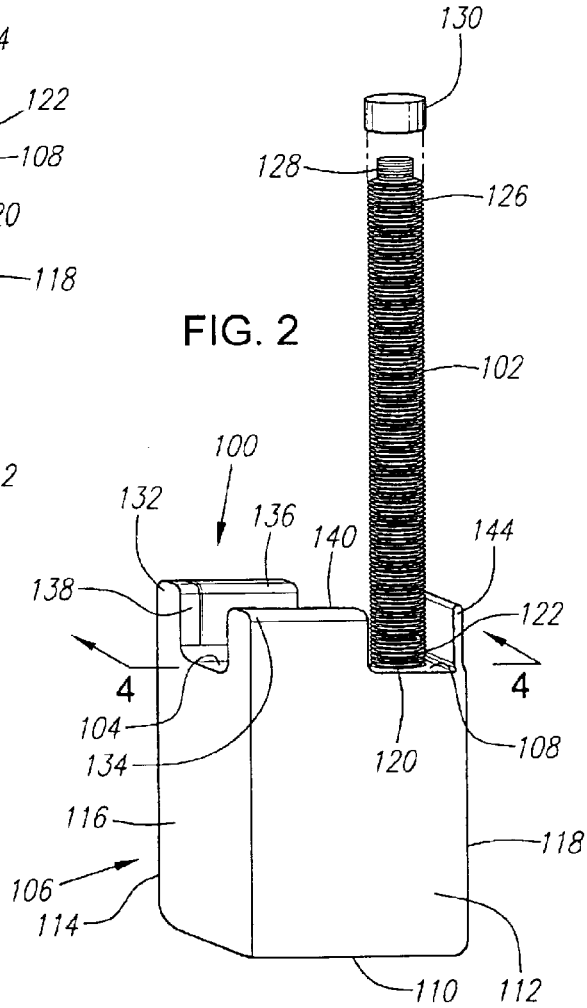
FIG. 2 is a perspective view of the fluid container of FIG. 1 showing the external channel molded within the top of the fluid container and the permanently attached collapsible tube shown vertically extended illustrating the bellows-like or accordion-like construction including a threaded cap.
Figure 3:
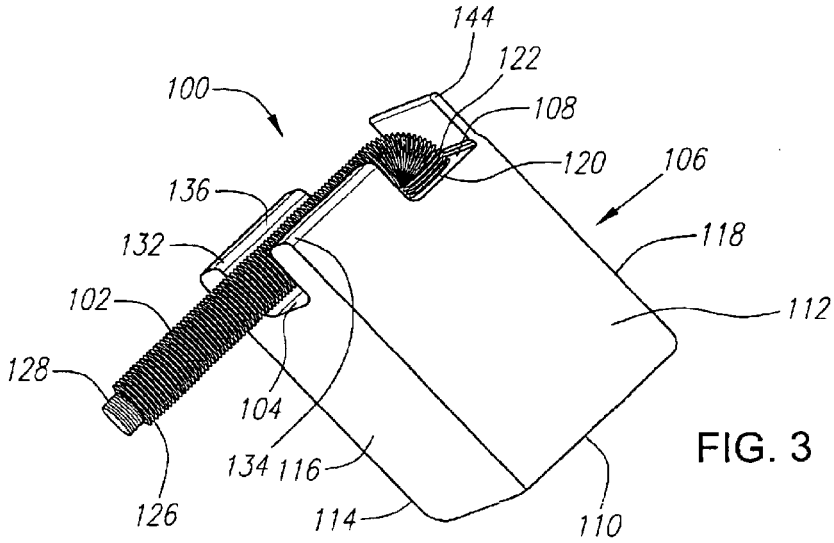
FIG. 3 is another perspective view of the fluid container of FIG. 1 showing the bellows-like collapsible tube in the extended position and resting laterally within the external molded channel illustrating a pouring position.

In the preferred embodiment, the fluid container 100 can be comprised of, for example, a rectangular housing 106 best shown in FIGS. 1–3 and preferably comprised of flexible but sturdy plastic. The rectangular housing 106 includes a top surface 108, a bottom surface 110, and four vertical sides including a front side 112, a rear side 114, a left side 116 and a right side 118 best shown in FIGS. 2, 3, 5 and 6. In the preferred embodiment, the front side 112 and the rear side 114 (shown best in FIGS. 5 and 6) are broader surfaces than the bottom surface 110, the left side 116 and the right side 118. The bottom surface 110 is essentially flat to facilitate upright standing of the fluid container 100 as is shown in FIG. 2. Although plastic is the preferred material, the fluid container 100 can be comprised of any suitable material including but not limited to metal, or even a treated paper product. Further, the outer surface of each of the front side 112, rear side 114, left side 116 and right side 118 can be somewhat roughened or dimpled to facilitate gripping by a human hand. However, certain areas of these surfaces may be smooth enough to permit an identification label to be affixed thereto with, for example, an adhesive.

Figure 4:
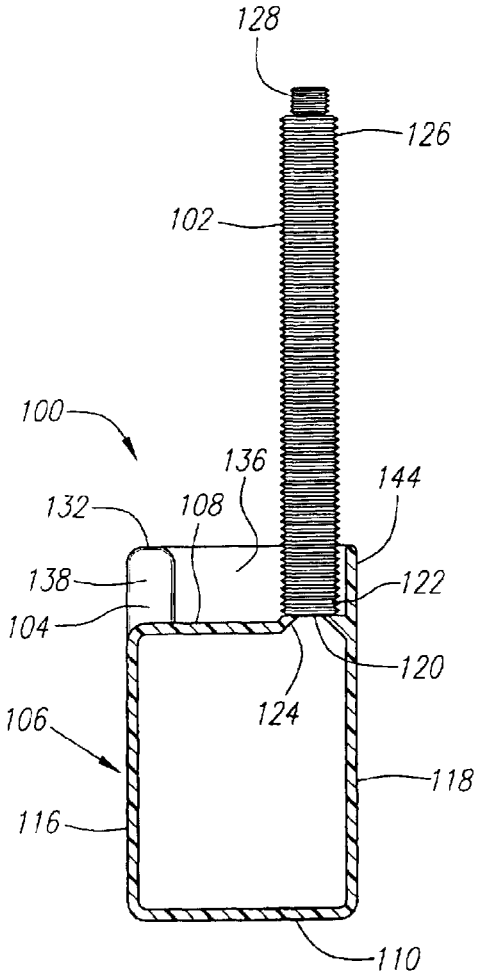
FIG. 4 is a cross-sectional view of the fluid container of FIG. 1 taken along the line 4—4 of FIG. 2 showing a portion of the external molded channel and the bellows-like collapsible tube shown vertically extended.
Figure 5:
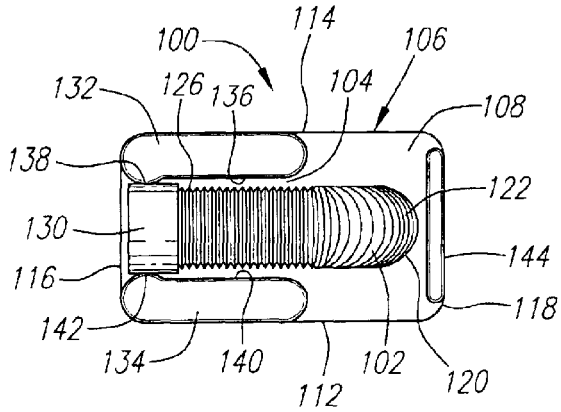
FIG. 5 is a top planar view of the fluid container of FIG. 1 showing the permanently attached, bellows-like collapsible tube resting laterally within the external channel molded within the top of the fluid container.
Figure 6:
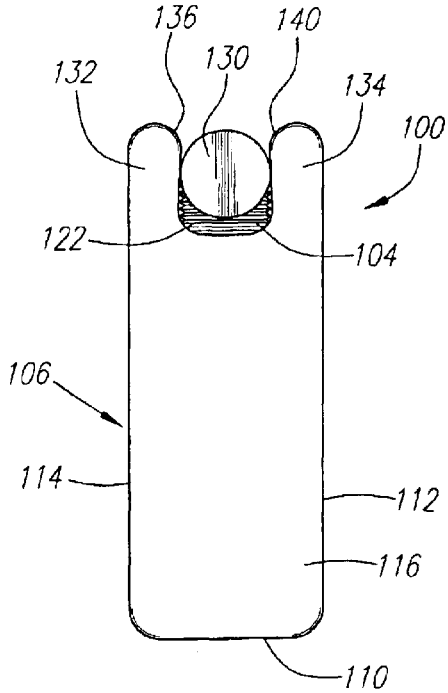
FIG. 6 is a left side elevation of the fluid container of FIG. 1 showing the threaded cap attached to the bellows-like collapsible tube resting laterally within the external channel molded within the top of the fluid container.

Portions of the top surface 108 are also flat as is shown in FIG. 5. However, unlike the remaining outer surfaces of the fluid container 100, the top surface 108 includes a single opening 120 formed therein as is shown best in FIG. 4. The fluid carried by the fluid container 100 exits the container from the opening 120 and out through the collapsible tube 102. Likewise, the air that replaces the exiting fluid enters the container 100 via the collapsible tube 102 and the opening 120. The single opening 120 can be, for example, funnel-shaped for interfacing with a proximal end 122 of the collapsible tube 102 as shown in FIG. 4. Both a rim or lip 124 (shown best in FIG. 4) of the single opening 120 and the collapsible tube 102 are comprised of plastic. Thus, the collapsible tube 102 is aligned with the single opening 120 and permanently affixed to the top surface 108 of the fluid container 100 at the rim or lip 124 by molding or fusing of the plastic components. In the alternative, the collapsible tube 102 can be molded to the top surface 108 of the rectangular housing 106 during the molding process employed to form the fluid container 100.

The collapsible tube 102 typically is comprised of plastic and includes the proximal end 122 and a distal end 126 as is shown in FIGS. 2 and 4. The length of the collapsible tube 102 serves as an exit path for the fluid stored within the inventive fluid container 100. The collapsible tube 102 exhibits the bellows-like or accordion-like construction as is clearly shown in FIGS. 2, 3 and 4. Consequently, the collapsible tube 102 can be manually extended and retracted. When the collapsible tube 102 is manually extended as is shown in FIGS. 2-4, insertion of the variety of initial or replacement fluids into the obstructed fill port (not shown) of, for example, an engine or other container is made more convenient. Initial or replacement fluids can include but are not limited to, water, oil, transmission fluid, brake fluid or other pourable materials. Pourable materials include granular materials as well as fluids. Likewise, when the collapsible tube 102 is manually retracted, it can be manipulated into a lateral position within the external molded channel 104 as is clearly shown in FIGS. 1, 5 and 6. The distal end 126 of the collapsible tube 102 includes a plurality of threads 128 as shown in FIGS. 3 and 4. The threads 128 of the collapsible tube 102 cooperate with and receive a threaded cap 130 as is clearly shown in FIG. 2 for preventing the fluid stored within the fluid container 100 from escaping via the collapsible tube 102.

The external molded channel 104 is clearly shown in FIGS. 1 –3, 5 and 6 of the preferred embodiment and is formed on the top surface 108 of the rectangular housing 106. As is shown best in FIG. 2, the external molded channel 104 is generally U-shaped and is located on that portion of the top surface 108 closest to the left side 116 (as opposed to the right side 118 ) of the rectangular housing 106. This feature is best shown in FIG. 5. The construction of the external molded channel 104 includes a pair of parallel vertical sides comprising a first parallel vertical side 132 and a second parallel vertical side 134 as is best shown in FIGS. 2 and 5. The first vertical side 132 and the second vertical side 134 form the U-shape of the external molded channel 104 as is clearly shown in FIGS. 2 and 6.

Formed on an inside surface 136 of the first vertical side 132 is a first protuberance 138 shown in FIG. 5. Likewise, formed on an inside surface 140 of the second vertical side 134 is a second protuberance 142 also shown in FIG. 5. This construction enables the U-shaped external molded channel 104 to receive the collapsible tube 102 when the collapsible tube 102 is in the retracted lateral position. Thus, when the bellows-like or accordion-like construction of the permanently attached collapsible tube 102 is manually retracted for reducing the length thereof, the collapsible tube 102 can be manipulated to assume a lateral position across the top surface 108 as is shown in FIG. 1. Under these conditions, the threaded cap 130 is typically affixed to the plurality of threads 128 at the distal end 126 of the collapsible tube 102 as is shown best in FIG. 2. The first protuberance 138 formed on the inside surface 136 of the first vertical wall 132 exhibits a separation distance from the second protuberance 142 formed on the inside surface 140 of the second vertical wall 134. This separation distance is selected so that the threaded cap 130 is conveniently grasped between the first protuberance 138 of the first vertical side 132 and the second protuberance 142 of the second vertical side 134 as is best shown in FIG. 5. Thus, the collapsible tube 102 is retained within the external molded channel 104 until physically moved. Once removed from the external molded channel 104, the collapsible tube 102 can be manually extended for use in inserting initial or replacement fluids into an obstructed or otherwise not conveniently accessible fill port (not shown).

Also formed on the top surface 108 of the rectangular housing 106 is an upright support 144 clearly shown in FIGS. 1–3 and 5. The upright support 144 typically is an extension of the right side 118 which can be molded to the top surface 108 of the rectangular housing 106 (in the same manner as is the first parallel vertical side 132 and the second parallel vertical side 134). This feature is clearly shown in the cross-sectional view of FIG. 4. It is intended that the height of the upright support 144, the first vertical side 132 and the second vertical side 134 each be substantially the same. In addition, the height of each of these three components is somewhat greater than the height of the permanently attached collapsible tube 102 and the threaded cap 130 when the tube 102 is in the retracted lateral position as is shown in FIGS. 1 and 3. The function of the upright support 144 in the preferred embodiment is to serve as a support component. It is noted that the first parallel vertical side 132 and the second parallel vertical side 134 also serve as support components in addition to forming the U-shaped external molded channel 104. Thus, the first vertical side 132 and the second vertical side 134 in conjunction with the upright support 144 facilitates vertical stacking of a plurality of the rectangular housings 106 of the inventive fluid containers 100 for storage, shipping and display when the collapsible tube 102 is in the retracted lateral position. These support components serve to prevent damage to the bellows-like collapsible tube 102 during the stacking of the housings 106 of the plurality of the fluid containers 100. This feature is shown in FIG. 1 in which the first rectangular housing 106 is shown stacked upon a second (identical) rectangular housing 146 of a second (identical) fluid container 148 shown in phantom.

In summary, the preferred embodiment of the present invention is directed to the fluid container 100 having (1) the permanently attached, flexible, bellows-like collapsible tube 102 for use in accessing an obstructed or otherwise not conveniently accessible fill port (not shown) of an engine or other container for inserting initial or replacement fluids therein, in combination with (2) the external molded channel 104 for nesting the collapsible tube 102 when in a retracted lateral position. In its most fundamental embodiment, the fluid container 100 includes the rectangular housing 106 for containing a fluid, the housing 106 having the top surface 108 with the single opening 120 formed therein. The collapsible tube 102 is aligned with the single opening 120 and is affixed to the housing 106 for providing an exit path for the fluid. The collapsible tube 102 can be manually extended and retracted. Finally, the external molded channel 104 is formed on the top surface 108 of the housing 106 for receiving the collapsible tube 102 when the collapsible tube 102 is in a retracted lateral position. The external molded channel 104 serves to facilitate vertical stacking of a plurality of the rectangular housings 106 of the fluid containers 100.

Figure 7:
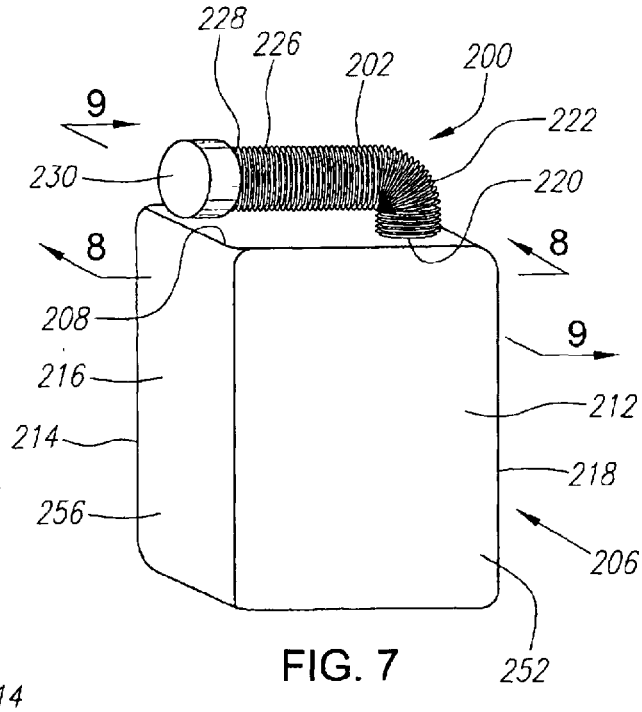
FIG. 7 is a perspective view of an alternative embodiment of the fluid container of the present invention having a permanently attached, bellows-like collapsible tube shown in the retracted lateral position on the top of the fluid container.
Figure 8:
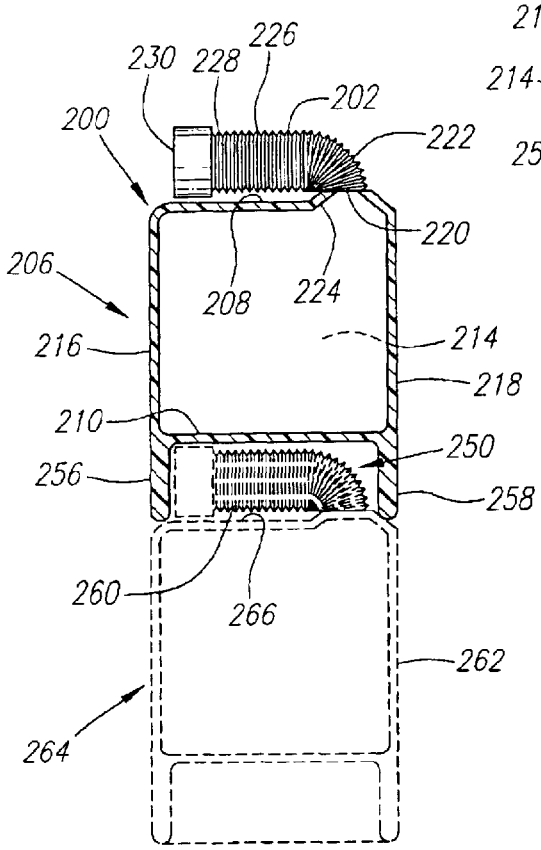
FIG. 8 is a cross-sectional view of the first fluid container of FIG. 7 taken along the line 8—8 of FIG. 7 showing the bellows-like collapsible tube in the retracted lateral position and a molded pocket formed within the bottom surface of the first fluid container, the first fluid container shown stacked above a second fluid container shown in phantom where a bellows-like collapsible tube of the second fluid container is nested within the molded pocket of the first fluid container.
Figure 9:
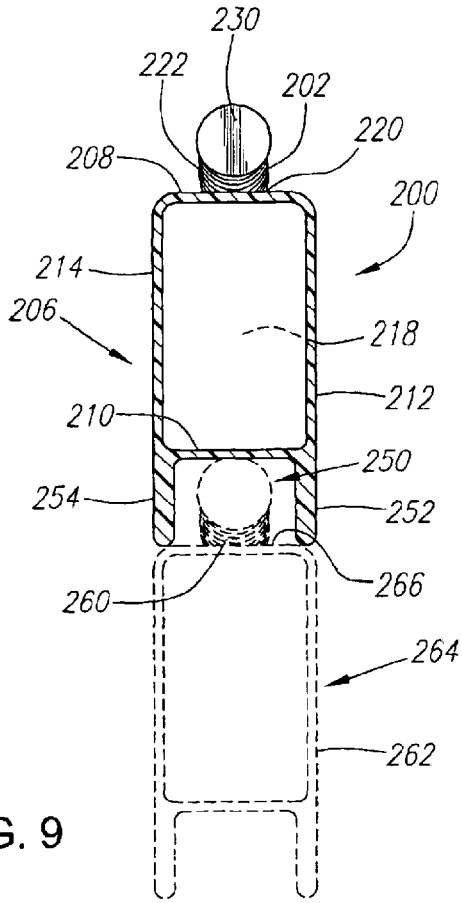
FIG. 9 is a cross-sectional view of the first fluid container of FIG. 7 taken along the line 9—9 of FIG. 7 showing the end of a threaded cap of the permanently attached, bellows-like collapsible tube resting laterally on the top of the first fluid container and the molded pocket formed within the bottom surface of the first fluid container, the first fluid container shown stacked above the second fluid container shown in phantom, where the bellows-like collapsible tube of the second fluid container is nested within the molded pocket of the first fluid container.

An alternative embodiment of the fluid container of the present invention is shown in FIGS. 7–9 and is referred to by the identification number 200. Each of the components appearing in the alternative embodiment 200 that correspond in structure and function to those components appearing in the preferred embodiment 100 is identified by the corresponding number of the 200 series.

The main elements of the fluid container 200 include many of the same components having the identical function as disclosed in the preferred embodiment 100. A collapsible tube 202 of the fluid container 200 exhibits a bellows-like or accordion-like construction and is permanently attached to a rectangular housing 206. Thus, the collapsible tube 202 can be extended and retracted. In particular, the collapsible tube 202 can be extended to insert a variety of initial or replacement fluids into a fill port (not shown) that is obstructed or otherwise not conveniently accessible. Likewise, the collapsible tube 202 can assume a retracted lateral position for storage on the rectangular housing 206 as shown in FIG. 7.

The fluid container 200 is comprised of the rectangular housing 206 best shown in FIGS. 7–9 and is preferably fashioned from flexible but sturdy plastic. The rectangular housing 206 includes a top surface 208, a bottom surface 210 and four vertical sides including a front side 212, a rear side 214, a left side 216 and a right side 218. In the preferred embodiment, the front side 212 and the rear side 214 (shown best in FIG. 9) are broader surfaces than the left side 216 and the right side 218. Although plastic is the preferred material, the fluid container 200 can be comprised of any suitable material including but not limited to metal, or even a treated paper product. Further, the outer surface of each of the front side 212, rear side 214, left side 216 and right side 218 can be somewhat roughened or dimpled to facilitate gripping by a human hand. However, certain areas of these surfaces may be smooth enough to permit an identification label to be affixed thereto with, for example, an adhesive.

The top surface 208 is also essentially flat as is shown in FIG. 7. However, unlike the remaining outer surfaces of the fluid container 200, the top surface 208 includes a single opening 220 formed therein as is shown best in FIG. 8. The fluid carried by the fluid container 200 exits the container from the opening 220 and out through the collapsible tube 202. Likewise, the air that replaces the exiting fluid enters the container 200 via collapsible tube 202 and the opening 220. The single opening 220 can be, for example, funnel-shaped for interfacing with a proximal end 222 of the collapsible tube 202 as shown in FIG. 8. Both a rim or lip 224 (shown best in FIG. 8) of the single opening 220 and the collapsible tube 202 are comprised of, for example, plastic. Thus, the collapsible tube 202 is aligned with the single opening 220 and permanently affixed to the top surface 208 of the rectangular housing 206 of the fluid container 200 at the rim or lip 224 by molding or fusing of the plastic components. In the alternative, the collapsible tube 202 can be molded to the top surface 208 of the rectangular housing 206 during the molding process employed to form the fluid container 200.

The collapsible tube 202 typically is comprised of plastic and includes the proximal end 222 and a distal end 226 as is shown in FIGS. 7–9. The length of the collapsible tube 202 serves as an exit path for the fluid stored within the inventive fluid container 200. The collapsible tube 202 exhibits the bellows-like or accordion-like construction as is clearly shown in FIGS. 7 and 8. Consequently, the collapsible tube 202 can be manually extended and retracted. When the collapsible tube 202 is manually extended, insertion of the variety of original or replacement fluids into the obstructed or otherwise not conveniently accessible fill port (not shown) of an engine or other container is made more convenient. Examples of original or replacement fluids include, for example, water, oil, transmission fluid, brake fluid or other pourable materials where pourable materials include granular materials as well as fluids. Likewise, when the collapsible tube 202 is manually retracted, it can be manipulated into a lateral position on the top surface 208 of the rectangular housing 206 as is clearly shown in FIGS. 7–9. The distal end 226 of the collapsible tube 202 includes a plurality of threads 228. The threads 228 of the collapsible tube 202 cooperate with and receive a threaded cap 230 as is clearly shown in FIG. 7 for preventing the fluid stored within the fluid container 200 from escaping via the collapsible tube 202.

The main structural modification appearing in the alternative embodiment 200 of the present invention is directed to the formation of a molded pocket 250 formed within the rectangular housing 206 as is best shown in FIGS. 8 and 9. In particular, the molded pocket 250 is formed beneath the bottom surface 210 of the rectangular housing 206 and is box-shaped in appearance. The bottom surface 210 is the bottom level of the interior of the rectangular housing 206 which serves to contain the fluid therein. Extending downward from the bottom surface 210 is a plurality of four pocket walls identified as a front pocket wall 252, a rear pocket wall 254, a left pocket wall 256 and a right pocket wall 258 as is clearly shown in FIGS. 8 and 9. As shown in the cross-sectional views of FIGS. 8 and 9, the four pocket walls 252, 254, 256 and 258 are not sealed from beneath and thus form the molded pocket 250.

The height of each of the pocket walls 252, 254, 256 and 258 is slightly greater than the height of the permanently attached collapsible tube 202 and the threaded cap 230 when in the retracted lateral position. Thus, a second (identical) collapsible tube 260 of a second (identical) rectangular housing 262 of a second (identical) fluid container 264 (shown in phantom in FIGS. 8 and 9 ) can conveniently fit within the molded pocket 250 of the rectangular housing 206 when the second (identical) collapsible tube 260 is in a retracted lateral position. This design structure facilitates the stacking of the fluid container 200 upon the second (identical) fluid container 264 which is useful in a storage, shipping and display environment. During stacking, the pocket walls 252, 254, 256 and 258 of the rectangular housing 206 conveniently rest upon the corresponding points of a second (identical) top surface 266 of the second (identical) rectangular housing 262 as is shown in FIGS. 8 and 9. In this manner, the plurality of rectangular housings 206, 262 of the fluid containers 200, 264 can be conveniently stacked.

In summary, the alternative embodiment of the fluid container 200 includes the rectangular housing 206 for containing a fluid having the top surface 208 and the bottom surface 210 with the single opening 220 formed in the top surface 208. The collapsible tube 202 is aligned with the single opening 220 in the top surface 208 and is affixed to the rectangular housing 206 for providing an exit path for the fluid. The collapsible tube 202 can be manually extended and retracted. The molded pocket 250 is formed beneath the bottom surface 210 of the rectangular housing 206 for receiving the second (identical) collapsible tube 260 of the second (identical) rectangular housing 262 when the second (identical) collapsible tube 260 of the second (identical) rectangular housing 262 is in a retracted lateral position. Thus, the molded pocket 250 of the rectangular housing 206 facilitates vertical stacking of the rectangular housing 206 and the second (identical) rectangular housing 262.

The present invention provides novel advantages over other fluid containers known in the prior art. A main advantage of the fluid container 100 is that it includes (1) a permanently attached collapsible tube 102 which can be extended for inserting a variety of pourable materials (i.e., granular materials or fluids) into an obstructed or otherwise not conveniently accessible fill port (not shown) of an engine or other container, in combination with (2) an external molded channel 104 formed on the top surface 108 of the rectangular housing 106 for receiving the collapsible tube 102 when in the retracted lateral position. In the alternative, (3) a molded pocket 250 formed beneath the bottom surface 210 of the rectangular housing 206 is fashioned to receive the second (identical) collapsible tube 260 of a second (identical) rectangular housing 262 when the second (identical) collapsible tube 260 of the second (identical) rectangular housing 262 is in a retracted lateral position. Both the external molded channel 104 of the fluid container 100 and the molded pocket 250 of the fluid container 264 are designed to facilitate vertical stacking of (4) the rectangular housing 106 of the fluid container 100 and the second (identical) rectangular housing 146 of the fluid container 148, and (5) the rectangular housing 206 of the fluid container 200 and the second (identical) rectangular housing 262 of the second (identical) fluid container 264.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention. Accordingly,

What is claimed is:

1. A fluid container comprising:

a housing for containing fluid, said housing having a top surface with an opening formed therein;

a collapsible tube aligned with said opening and affixed to said housing for providing an exit path for said fluid, said collapsible tube being manually extendable and retractable; and a U-shaped channel formed on said top surface of said housing for receiving said collapsible tube when said collapsible tube is in a retracted lateral position, said U-shaped channel for facilitating vertical stacking of a plurality of said housings.

2. The fluid container of claim 1 wherein said collapsible tube comprises a bellows-like flexible construction.

3. The fluid container of claim 1 wherein said collapsible tube is permanently affixed to said housing.

4. The fluid container of claim 1 wherein said collapsible tube includes a threaded distal end for receiving a threaded cap.

5. The fluid container of claim 1 wherein said U-shaped channel includes a pair of parallel vertical sides.

6. The fluid container of claim 1 wherein said top surface of said housing further includes an upright support for facilitating vertical stacking of said plurality of said housings.

7. The fluid container of claim 1 wherein said housing is comprised of plastic.

8. The fluid container of claim 1 wherein said housing is comprised of metal.

9. A fluid container comprising:

a housing for containing fluid, said housing having a top surface with an opening formed therein;

a collapsible tube aligned with said opening and permanently affixed to said housing for providing an exit path for said fluid, said collapsible tube having a bellows-like flexible construction and being manually extendable and retractable; and a U-shaped channel formed on said top surface of said housing for receiving said collapsible tube when said collapsible tube is in a retracted lateral position, said U-shaped channel including a pair of parallel vertical sides for facilitating vertical stacking of a plurality of said housings.

10. The fluid container of claim 9 wherein said collapsible tube includes a threaded distal end for receiving a threaded cap.

11. The fluid container of claim 9 wherein said top surface of said housing further includes an upright support for facilitating vertical stacking of said plurality of said housings.

12. The fluid container of claim 9 wherein said housing is comprised of plastic.

13. The fluid container of claim 9 wherein said housing is comprised of metal.

14. A fluid container comprising:

a first housing for containing fluid, said first housing having a top surface and a bottom surface, said top surface having an opening formed therein;

a collapsible tube aligned with said opening in said top surface and affixed to said first housing for providing an exit path for said fluid, said collapsible tube of said first housing being manually extendable and retractable and adjustable to a retracted lateral position; and a molded pocket formed beneath said bottom surface of said first housing for receiving a collapsible tube of a second housing when said collapsible tube of said second housing is in a retracted lateral position, said molded pocket of said first housing for facilitating vertical stacking of said first housing and said second housing.

15. The fluid container of claim 14 wherein said collapsible tube of said first housing comprises a bellows-like flexible construction.

16. The fluid container of claim 14 wherein said collapsible tube of said first housing includes a threaded cap.

17. The fluid container of claim 14 wherein said molded pocket of said first housing includes a plurality of downward extending sidewalls.

18. The fluid container of claim 14 wherein said molded pocket of said first housing is box-shaped.

19. The fluid container of claim 14 wherein said first housing is comprised of plastic.

* * * * *